US009975730B2

(12) United States Patent
Perälä et al.

(10) Patent No.: US 9,975,730 B2
(45) Date of Patent: May 22, 2018

(54) METHOD FOR DETERMINING THE BALANCING WEIGHT DIFFERENCE IN AN ELEVATOR

(71) Applicant: KONE Corporation, Helsinki (FI)

(72) Inventors: Pekka Perälä, Kerava (FI); Riku Lampinen, Helsinki (FI); Risto Jokinen, Hyvinkää (FI); Tapio Tyni, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 397 days.

(21) Appl. No.: 14/812,595

(22) Filed: Jul. 29, 2015

(65) Prior Publication Data

US 2015/0329320 A1 Nov. 19, 2015

Related U.S. Application Data

(63) Continuation of application No. PCT/EP2014/053688, filed on Feb. 26, 2014.

(30) Foreign Application Priority Data

Mar. 4, 2013 (EP) ..... 13157535

(51) Int. Cl.
*B66B 1/34* (2006.01)
*B66B 5/00* (2006.01)

(52) U.S. Cl.
CPC ..... *B66B 1/3476* (2013.01); *B66B 5/0025* (2013.01); *B66B 5/0087* (2013.01)

(58) Field of Classification Search
CPC .... B66B 1/3476; B66B 5/0025; B66B 5/0087
(Continued)

(56) References Cited

U.S. PATENT DOCUMENTS 4,793,442 A * 12/1988 Heckler ..... B66B 1/28 187/292
4,939,679 A * 7/1990 David ..... B66B 1/3484 187/292

(Continued)

FOREIGN PATENT DOCUMENTS

DE 10 2009 038 498 A1 2/2011
JP 04201957 A * 7/1992

OTHER PUBLICATIONS

Tyni et al., "Electric Site Survey—On Quest of Elevator Parameters", Elevator Technology 19, Proceedings of Elevcon, XP055064992, May 24, 2012.

*Primary Examiner* — Anthony Salata
(74) *Attorney, Agent, or Firm* — Birch, Stewart, Kolasch & Birch, LLP

(57) ABSTRACT

In a method for performing a balance check with an elevator, a power model of the elevator is established, including the motor power fed to the motor ($P_M$) and power parameters of the motor and the moved components in the hoistway ($P_K$, $P_P$, $P_{Fr}$, $P_{Cu}$, $P_{Fe}$), a test run of the elevator is made, mid motor power values for the up and down direction are determined, i.e. the power fed to the motor at the instant when the car is moving through the middle of the travelling path of the elevator in up and down direction with constant velocity, the difference between the mid power value in up and down direction is determined, the balancing weight difference is obtained from said mid power value difference. This method allows an easy determination of the elevator balance preferably in course of modernizations of an elevator system with a new elevator motor.

20 Claims, 3 Drawing Sheets

(58) Field of Classification Search
USPC ..... 187/247, 281, 391, 393; 177/132, 136, 177/142, 147, 235
See application file for complete search history.

(56) References Cited

U.S. PATENT DOCUMENTS

| | | | | |
|---|---|---|---|---|
| 5,343,003 | A * | 8/1994 | Jamieson | B66B 1/3476 177/132 |
| 5,407,030 | A * | 4/1995 | Burton | B66B 1/28 177/264 |
| 5,531,294 | A * | 7/1996 | Burton | B66B 1/28 187/292 |
| 6,264,005 | B1 * | 7/2001 | Kang | B66B 5/027 187/290 |
| 6,315,081 | B1 * | 11/2001 | Yeo | B66B 5/02 187/290 |
| 6,450,299 | B1 * | 9/2002 | Lysaght | B66B 1/3484 187/393 |
| 7,222,698 | B2 * | 5/2007 | Hanninen | B66B 5/0093 187/393 |
| 7,971,688 | B2 * | 7/2011 | Perala | B66B 1/3407 187/293 |
| 2010/0276230 | A1 | 11/2010 | Perälä et al. | |

* cited by examiner

100: elevator
11: hoistway
12: elevator car
13: counterweight
14: elevator control
15: software module
16: elevator maintenance or installation tool
20: motor

METHOD FOR DETERMINING THE BALANCING WEIGHT DIFFERENCE IN AN ELEVATOR

CROSS REFERENCE TO RELATED APPLICATIONS

This application is a Continuation of PCT International Application No. PCT/EP2014/053688, filed on Feb. 26, 2014, which claims priority under 35 U.S.C. 119(a) to Patent Application No. 13157535.9, filed in Europe on Mar. 4, 2013, all of which are hereby expressly incorporated by reference into the present application.

BACKGROUND OF THE INVENTION

1. Field of the Invention

The present invention relates to a method for performing a balance check with an elevator, i.e. to determine the balancing weight difference in an elevator.

2. Description of Background Art

Often, in course of the modernization of existing elevators and elevator groups, a new elevator motor and motor drive is installed in an existing elevator. For the optimization of the new motor drive and elevator motor to the existing elevator system, it is preferable to perform a balance check, i.e. to determine the weight difference between the weight of the empty elevator car and the counterweight (=balancing weight difference) in the elevator system.

Usually, the weight of a counterweight corresponds to the weight of the empty elevator car plus the half of the nominal load of the elevator. As often during the lifetime of an elevator, several modifications are made at the elevator car and also at the counterweight the real values often deviate essentially from the above assumptive theoretical values. Sometimes there are information tags at the elevator components with the properties of the elevator component as e.g. the weight. But as mentioned above, the weight may have been modified during the operating time of the elevator. The weighing of the elevator components, i.e. the weighing of the elevator car and the counterweight are laborious tasks which would need essential effort and costs.

SUMMARY OF THE INVENTION

Accordingly, it is object of the present invention to provide a method for easily obtaining the balancing weight difference of an existing elevator system.

The object is solved with the method of claim 1. Preferred embodiments of the invention are subject-matter of the dependent claims. Inventive embodiments are also presented in the description and drawings of the present invention. The inventive content may also consist of several separate inventions, especially if the invention is considered in the light of explicit or implicit subtasks or in respect of advantages or set of advantages achieved. In this case, some of the attributes contained in the claims below may be superfluous from the point of view of separate inventive concepts. Similarly within the framework of the basic concept of the invention, different details described in connection with each example embodiment of the invention may be used in other example embodiments as well. According to the present invention, the balance check for the elevator is simplified essentially by using a simplified power model of the elevator which comprises the motor power fed to the motor ($P_M$) and power parameters of the motor and the moved components in the hoistway ($P_K$, $P_P$, $P_{Fr}$, $P_{Cu}$, $P_{Fe}$). With such a model the behavior of the elevator system can be simplified as to retrieve the balancing weight difference (=weight difference between particularly empty car and counterweight) in an easy manner.

Preferably, the power model is chosen as follows:

$$P_M=P_K+P_P+P_{Fr}+P_{Cu}+P_{Fe} \quad (1)$$

In this model, $P_M$=power fed to the elevator, $P_K$=kinetic power of the moved elevator components, $P_P$=potential power of the moved elevator components, $P_{Fr}$=frictional losses of the elevator components, $P_{Cu}$=internal motor losses in the winding resistance, $P_{Fe}$=motor internal iron losses.

The power model model simplifies an elevator system by modelling the power flow in said system. For retrieving the necessary information for the balance check, a test run of the elevator is made whereby normally the elevator car is driven in at least one closed loop to the upper end as well as to the lower end of its travelling path.

According to the invention, the power difference in both running directions of the elevator car is considered when the elevator is driving with constant speed. Via this measure the kinetic power of the system which amounts to $m_I \cdot v \cdot a$ (whereby $m_I$ is the mass of the moved components of the elevator system) can be disregarded.

According to the invention, the power difference in the up and down direction only in the middle of the travelling path is considered. In the middle of the travelling path, all moved elevator components except the car and counterweight are balanced in the middle of the travelling path where the car is aside of the counterweight. Accordingly at this point the weight portion of these components can be disregarded in the middle of the travelling path. These components are e.g. suspension ropes, hoisting ropes or compensation ropes. Accordingly the relevant components for the balance check remain the car and the counterweight, which are the essential weight components for the balance check.

Via the simplified elevator model and the use of the power data of the motor in the middle of the travelling path of the elevator driving with constant velocity, the model used in the inventive method can be simplified as to remove all components which are based on acceleration, all components which are independent of the travelling direction as e.g. iron losses and thus via the difference of the corresponding power values for both directions the balancing weight difference of the elevator can immediately be calculated.

The invention also relates to a system for implementing the inventive method. Such a system may be a part of the elevator control which is integrated with the elevator control or provided separately.

The system can also be implemented in a hardware and/or software module (e.g., 15 in FIG. 3) of the elevator control (e.g., 14 in FIG. 3) or in an elevator maintenance or installation tool (e.g., 16 in FIG. 3) used by a service technician to install or service the elevator.

Of course, the system shall have an input for the motor power fed to the motor and an input for the car position, which inputs are connectable to the elevator system. Via these inputs the system gets the information about the motor power $P_M$ as well as the car position to determine the middle position of the car or counterweight in the elevator shaft.

BRIEF DESCRIPTION OF THE DRAWINGS

The invention shall be described hereinafter in connection with the drawings. In these drawings

DETAILED DESCRIPTION OF THE INVENTION

Figure 3:
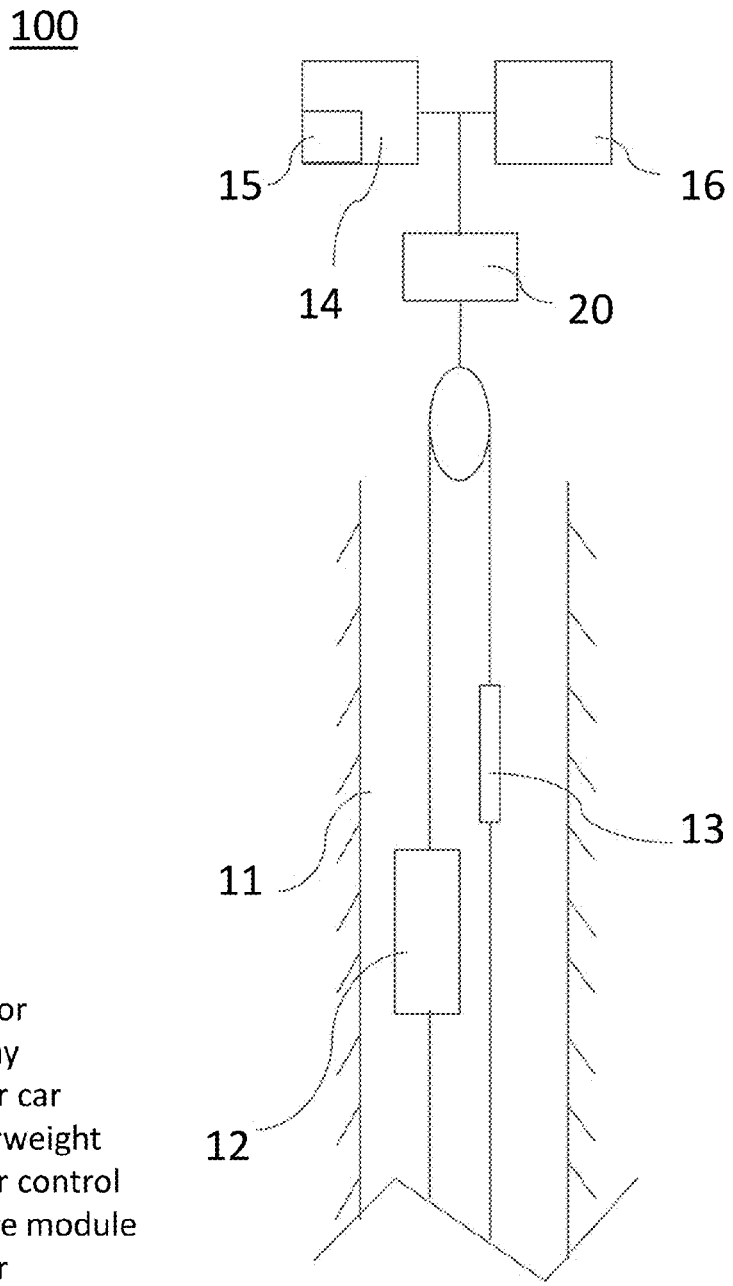
FIG. 3 shows an elevator system according to one embodiment of the present invention.

FIG. 3 shows an elevator 100 including an elevator car 12 and a counterweight 13 driven by a motor 20 to move in a hoistway 11.

Figure 1:
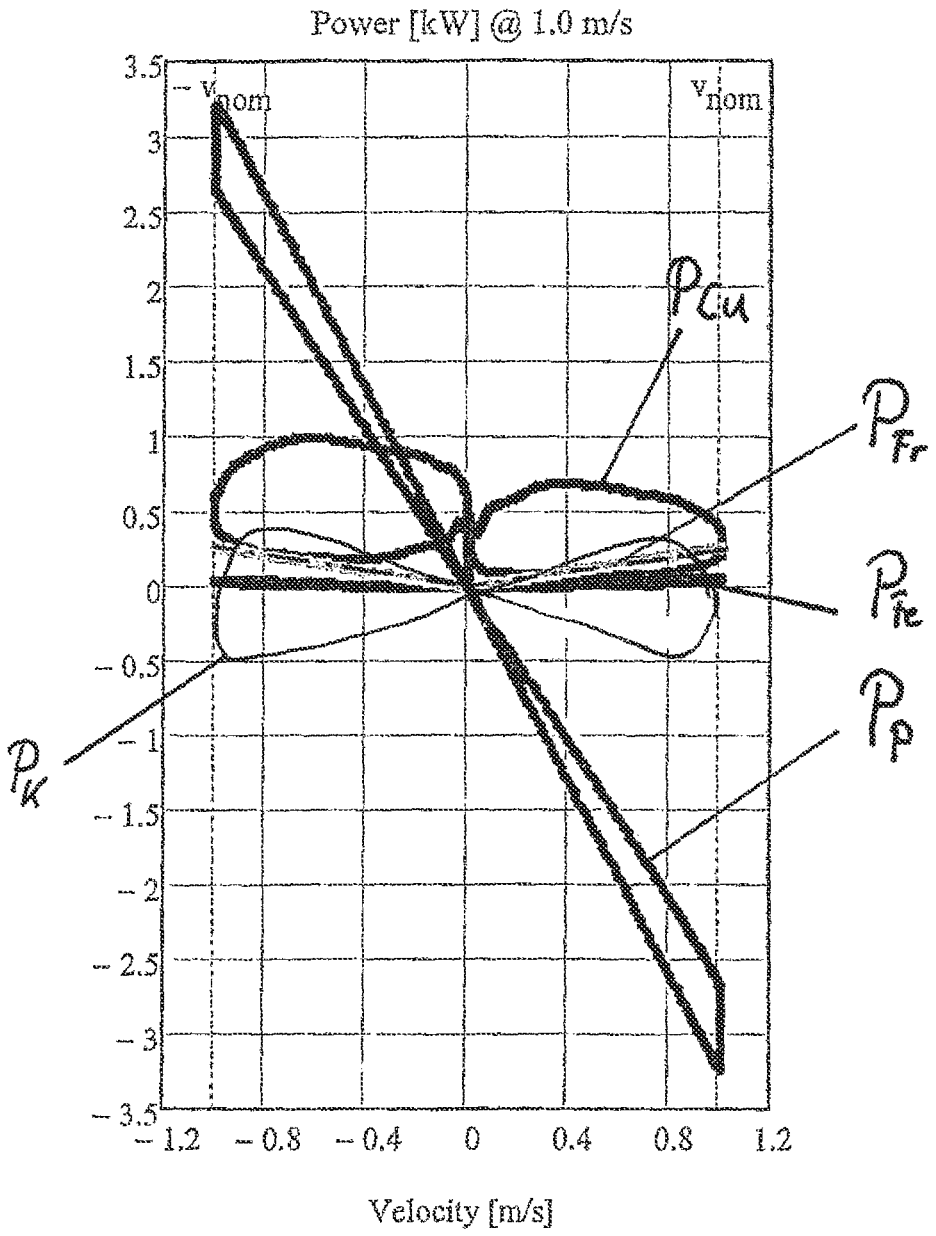
FIG. 1 shows a diagram with the velocity versus power comprising different power parameters of the elevator model, FIG. 2 the significant power values used in the model for obtaining the balancing weight difference of an elevator system.

FIG. 1 shows a diagram where the velocity is shown in horizontal direction and the power is shown in vertical direction. The diagram shows the portion of different power parameters of the inventive power model during the drive of an elevator car (e.g., 12 in FIG. 3) in a test run.

Figure 2:
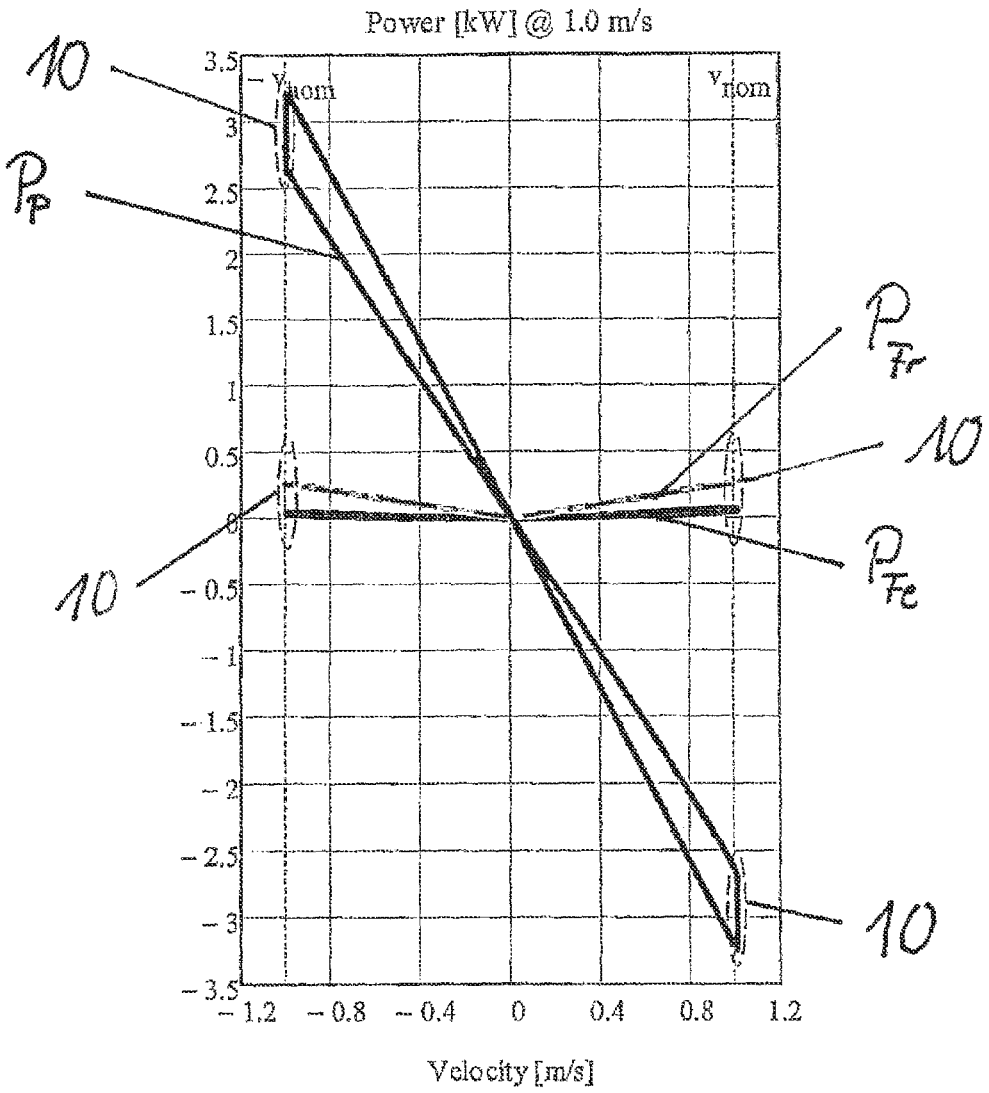

The inventive balance check is based on the power model (1). According to the invention, the power model is only considered in areas of the test run in which the elevator runs with constant speed. In FIG. 2, these areas are illustrated with ellipses 10. During the test run the power $P_M$ fed to the motor (e.g., 20 in FIG. 3) is measured during a test run.

The kinetic energy $P_K$ amounts to $m_I \cdot v \cdot a$, whereby $m_I$ is the mass of the moved components of the elevator system. As only the constant speed area 10 of the test run is considered, the acceleration is zero and accordingly the kinetic power diminishes to zero.

The power parameter of the copper losses can be easily calculated from the motor current $I_M$ and the motor winding resistance $R_S$ ($P_{Cu}=I_M^2 \cdot R_S$) as these are the operating parameters of the new elevator motor which is provided to substitute the old complete elevator drive. These copper losses can be subtracted from the motor input power $P_{ME}=P_M-P_{Cu}$, with $P_{ME}$ designates the amended motor power reduced by the copper losses in the motor windings.

Accordingly, the above-mentioned power model under equation 1 simplifies to:

$$P_{ME}=P_P+P_{Fr}P_{Fe} \tag{2}$$

In the following, not only the constant speed area is monitored but the difference between the power values for the motor power in upwards and downwards direction. This fact leads to the removal of power components which are independent of the travelling direction. Accordingly, the power parameters friction losses $P_{Fr}$ and iron losses $P_{Fe}$ are assumed to be independent of the travel direction and are therefore eliminated when the difference of the power values between upwards and downwards movement is formed. This reduces the above formula under 2 to:

$$P_{ME(up)}-P_{ME(dn)}=P_{P(up)}-P_{P(dn)} \tag{3}$$

Accordingly, the power difference in upwards and downwards direction is only dependent on the potential power parameter which contains all elevator components which are moved vertically in the elevator shaft as e.g. car (e.g., 12 in FIG. 3), counterweight (e.g., 13 in FIG. 3), hoisting ropes, suspension ropes and compensation ropes.

According to the invention, the power difference, i.e. the difference in the power fed to the elevator motor in upwards and downwards direction is only regarded for the middle of the travelling path where the elevator car is located aside of the counterweight, i.e. on the same level. In this position, the weight of other moved elevator components except car and counterweight, as e.g. the hoisting ropes, suspension or compensation ropes is balanced and can thus be disregarded. Accordingly, in this mid position, only the weight of the car and counterweight is relevant. By applying the reduced and simplified power model of equation 3 to the circumstance of the consideration only in the mid part of the travelling path, following equation 4 is obtained:

$$P_{ME,mid,up}-P_{ME,mid,dn}=m_B \cdot g \cdot (-v_{nom}) \tag{4}$$

whereby $m_B$ is the balancing weight difference or balance of the elevator system in kilogram, and $v_{nom}$ is the nominal speed of the elevator. g is the gravitational acceleration=9,81 $m/s^2$.

From this equation the balancing weight difference $m_B$ is obtained by $$m_B = \frac{(P_{ME,mid,up} - P_{ME,mid,dn})}{2 \cdot g \cdot v_{nom}} \tag{5}$$

In other words: The drive unit is able to calculate the elevator system balance at the middle point of the shaft by calculating during the constant speed run the motor current from which the copper losses are removed in up and down directions and dividing the difference with the nominal velocity and g.

Instead of taking one power value in the middle of the elevator shaft, the mean value of several test runs can be taken in which case the arithmetical mean value has to be used. Of course, the use of a mean value from several test runs obtains a more accurate number for the balancing weight difference of the elevator system in the middle of the elevator shaft.

Table 1 shows results of a test that was conducted to check the operation of theory and practice with an example elevator. The correct balancing of the elevator is −300 kg (the negative prefix means that the counterweight is heavier).

| "$P_{Cu}$" | "$P_{Fe}$" | "$m_B$ [kg]" |
|---|---|---|
| 0 | 0 | −316 |
| 0 | 1 | −317 |
| 1 | 0 | −300 |
| 1 | 1 | −301 |

Table 1 shows the power parameter of the copper losses "$P_{Cu}$" as well as the power parameter of the iron losses "$P_{Fe}$" and the balancing weight difference obtained by the model "$m_B$ [kg]".

In the table, 0 indicates that the corresponding power term is disregarded whereas a 1 indicates that the power term has correctly been calculated and removed from the motor power.

It can be seen from table 1 that the copper losses have to be correctly calculated and removed from the motor power as they add a significant portion of at least 5% to the balancing weight value. On the other side, it can be seen that the iron losses only make a weight difference of 1 kg so that the iron losses can simply be disregarded as they are assumed being identical for the up and down direction. As it can be seen from this example, the error obtained by this assumption is in the area of 0.3%.

Accordingly, the invention allows a very easy and uncomplicated balance check whereby the inventive method can be applied in a balance check module of the elevator control or in a separate module which is able to obtain the absolute and/or relative car positions in the elevator shaft as well as the power fed to the elevator motor.

Of course, the inventive method can be applied in a program installed in the elevator control unit or in a maintenance- or operating-tool for a service technician.

The invention can be varied within the scope of the appended patent claims.

The invention claimed is:

1. A method for determining a balancing weight difference in an elevator, said method comprising the steps of:

establishing a power model of the elevator, comprising a motor power fed to a motor ($P_M$) and power parameters of the motor and moved components in a hoistway ($P_K$, $P_P$, $P_{Fr}$, $P_{Cu}$, $P_{Fe}$);

making a test run of the elevator;

determining motor power values ($P_{ME,mid,up}+P_{ME,mid,dn}$) for an up and down direction;

determining a difference between the mid power value in up and down direction; and obtaining the balancing weight difference ($m_B$) from said mid power value difference.

2. The method according to claim 1, wherein the power model is:

$$P_M=P_K+P_P+P_{Fr}+P_{Cu}+P_{Fe},$$

wherein $P_M$=Power fed to the elevator motor, $P_K$=kinetic power of the moved elevator components, $P_p$=potential power of the moved elevator components, $P_{Fr}$=frictional losses, $P_{Cu}$=internal motor losses in the winding resistance, and $P_{Fe}$=motor internal iron losses.

3. The method according to claim 2, wherein copper losses $P_{Cu}$ are calculated using the motor current and motor winding resistance.

4. The method according to claim 2, wherein the motor internal iron losses $P_{Fe}$ in the model are deemed being identical in the up and down direction.

5. The method according to claim 2, wherein the friction losses $P_{Fr}$ in the model are deemed being identical in the up and down direction.

6. The method according to claim 1, wherein several test runs are made or wherein the test run comprises several transits of an elevator car through a middle of a travelling path, whereby a mean value of power values of said transits are used for establishing the difference of the power values in the middle of the travelling path in up and down direction.

7. A system for implementing the method according to claim 1.

8. The system according to claim 7, having an input for the motor power fed to the motor and an input for a car position, inputs being connectable to an elevator system.

9. The system according to claim 7, the system being a part of a elevator control.

10. The system according to claim 9, wherein the method is implemented in a software module of the elevator control.

11. The system according to claim 7, wherein the system is implemented in an elevator maintenance or installation tool.

12. The method according to claim 1, wherein in said step of determining motor power values ($P_{ME,mid,up}+P_{ME,mid,dn}$) for the up and down direction, the power fed to the motor at the instant when an elevator car is moving through a middle of a travelling path of the elevator in the up and down direction with constant velocity is determined.

13. The method according to claim 3, wherein the motor internal iron losses $P_{Fe}$ in the model are deemed being identical in the up and down direction.

14. The method according to claim 3, wherein the friction losses $P_{Fr}$ in the model are deemed being identical in the up and down direction.

15. The method according to claim 4, wherein the friction losses $P_{Fr}$ in the model are deemed being identical in the up and down direction.

16. The method according to claim 2, wherein several test runs are made or wherein the test run comprises several transits of an elevator car through a middle of a travelling path, whereby a mean value of power values of said transits are used for establishing the difference of the power values in the middle of the travelling path in up and down direction.

17. The method according to claim 3, wherein several test runs are made or wherein the test run comprises several transits of an elevator car through a middle of a travelling path, whereby a mean value of power values of said transits are used for establishing the difference of the power values in the middle of the travelling path in up and down direction.

18. The method according to claim 4, wherein several test runs are made or wherein the test run comprises several transits of an elevator car through a middle of a travelling path, whereby a mean value of power values of said transits are used for establishing the difference of the power values in the middle of the travelling path in up and down direction.

19. The method according to claim 5, wherein several test runs are made or wherein the test run comprises several transits of an elevator car through a middle of a travelling path, whereby a mean value of power values of said transits are used for establishing the difference of the power values in the middle of the travelling path in up and down direction.

20. A system for implementing the method according to claim 2.

* * * * *